United States Patent [19]

Hazard

[11] Patent Number: 4,875,251

[45] Date of Patent: Oct. 24, 1989

[54] TOILET SEAT HANDLE OF UNITARY CONSTRUCTION

[76] Inventor: James T. Hazard, 311 Fairmeade Rd., Louisville, Ky. 40207

[21] Appl. No.: 288,480

[22] Filed: Dec. 22, 1988

[51] Int. Cl.[4] ..... A47K 13/10

[52] U.S. Cl. ..... 16/111 R; 16/114 R; 16/DIG. 24; 4/251

[58] Field of Search ..... 16/111 R, 114 R, DIG. 24, 16/DIG. 40; 4/234, 237, 242, 251

[56] References Cited

U.S. PATENT DOCUMENTS

| | | | |
|---|---|---|---|
| 1,999,555 | 4/1935 | Adams | 4/251 |
| 3,191,193 | 6/1965 | Bogenberger | 4/251 |
| 3,524,215 | 8/1970 | Kurtz | 16/124 |
| 3,717,884 | 2/1973 | Mantooth | 4/251 X |
| 4,574,401 | 3/1986 | Nakajima | 4/251 |
| 4,742,582 | 5/1988 | Giallourakis | 4/251 |

*Primary Examiner*—Nicholas P. Godicl
*Assistant Examiner*—William S. Andes
*Attorney, Agent, or Firm*—Charles G. Lamb

[57] ABSTRACT

A toilet seat handle device for attachment to a toilet seat as an aid to raising and lowering the toilet seat without having to actually touch the toilet seat. The handle is attached at one of its ends to the toilet seat and projects outwardly beyond the periphery thereof.

8 Claims, 1 Drawing Sheet

TOILET SEAT HANDLE OF UNITARY CONSTRUCTION

BACKGROUND OF THE INVENTION

1. Field of the Invention

The present invention relates to toilet seats, and more particularly, to a handle for attachment to a toilet seat.

2. Discussion of the Prior Art

One problem with toilet seats is that one must touch the seat in order to raise and lower it onto the toilet bowl. Toilet seats, by their very nature of use, are unsanitary as few people, if any, disinfect them after use.

SUMMARY OF THE INVENTION

The present invention recognizes the problem and presents a solution which is relatively inexpensive.

The present invention provides a toilet seat handle which can be located about the periphery of the seat in any location convenient for the user, and on any particular installation of a toilet.

More particularly, the present invention provides a toilet seat handle device for attachment to a toilet seat as an aid to raising and lowering the seat comprising a base portion configured to fit against the bottom side of the toilet seat; means for attaching the base portion to the bottom side of the toilet seat; and a handle portion attached to the base portion and extending therefrom such that when the base portion is attached to the toilet seat, the handle portion extends outwardly beyond the outside periphery of the toilet seat.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
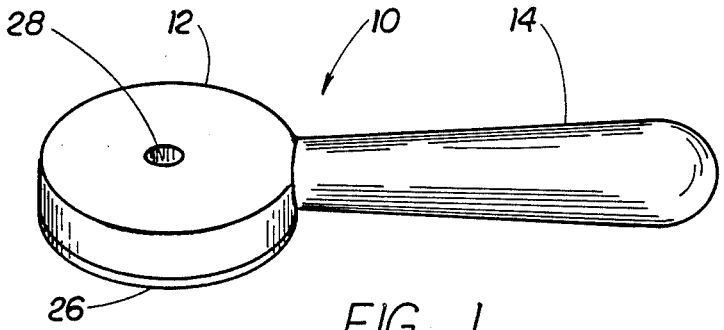
FIG. 1 is a perspective view of the handle device of the present invention showing the bottom side of the handle device.
Figure 2:
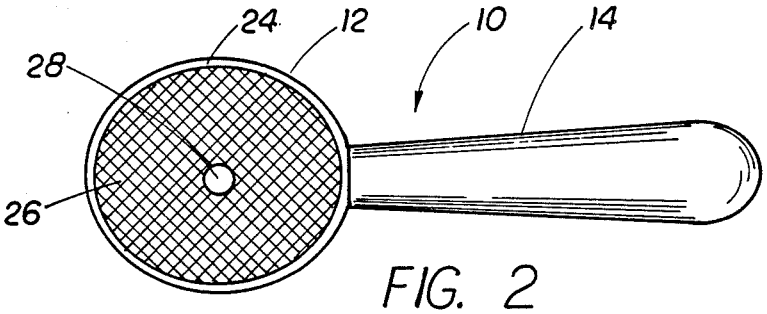
FIG. 2 is a top view of the handle device of the present invention.

FIGS. 1 and 2 best show the toilet seat handle device generally denoted as the numeral 10, of the present invention. The handle 10 comprises a base portion 12 and an elongated handle portion 14 attached to and extending from the base portion 12. Preferrably, the base portion 12 and handle portion 14 are unitarily formed, and the handle portion 14 preferably has a diameter at its attachment end substantially equal to the thickness of the base portion 12. And, even more preferable, the handle portion 14 includes a coating of material at selected portions thereon that is visible or glows in the dark. Virtually any rigid material that provides some degree of resilience is suitable for the handle device 10, such as wood or plastic. Plastic has the advantage that the handle device 10 can be made by any known and well suited molding technique.

Figure 3:
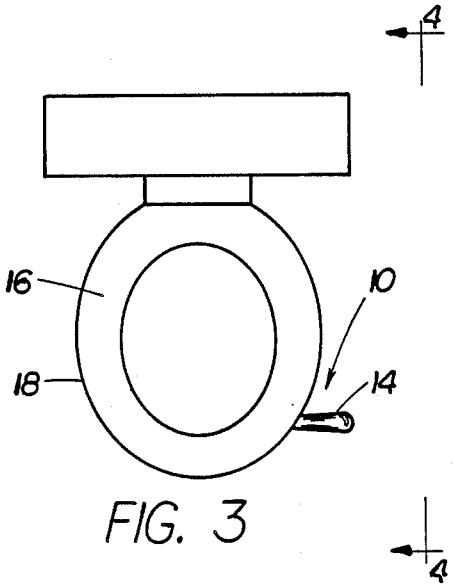
FIG. 3 is a top view of a toilet seat with the handle device of the present invention installed thereon; and, FIG. 4 is a side view of a toilet seat as seen in the direction of arrows 4—4 in FIG. 3 with the handle device of the present invention installed thereon.
Figure 4:
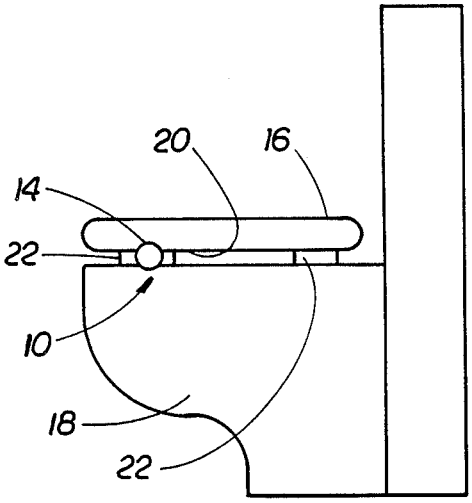

With reference to FIGS. 3 and 4, there is shown a typical toilet seat 16 pivotally mounted to a toilet bowl

18. Most commonly, the bottom side 20 of the toilet seat 16 has resilient support spacer bumpers 22 attached thereto which abut the toilet bowl rim when the toilet seat 16 is in the position overlaying the toilet bowl rim.

With reference to FIGS. 1 through 4, the base portion 12 of the handle device 10 has a top side 24 which is configured to fit against the bottom side 20 of the toilet seat 16. In addition, the thickness of the base portion 12 of the handle device 10 is equal to or less than the thickness of the spacer bumpers 22 of the toilet seat 16.

The handle device 10 is affixed to the toilet seat 16 at the base portion 12 of the handle device 10. Various fastener means can be used, however, preferrably the base portion 12 of the handle device 10 is adhesively attached or affixed to the bottom side 20 of the toilet seat 16. Toward this end, the top side 24 of the handle device 10 can have a coating 26 of a contact type adhesive material.

In many toilet seat designs, the resilient support spacer bumpers 22 are attached to the bottom side 20 of the toilet seat 16 by screws. Alternatively, it is contemplated that the base portion 12 of the handle device 10 can be formed with an appropriately sized screw fastener receiving hole 28 therethrough, and that the handle device 10 be attached to the toilet seat 16 by removing one of the support spacer bumpers 22 and replacing it with the handle device 10 fastening the handle device 10 in place with the same screw which fastened the support spacer bumper 22 to the toilet seat 16. In this instance, it is advantageous that the base portion 12 be of substantially the same thickness as the spacer bumpers 22.

When the base portion 12 of the handle device 10 is attached to the toilet seat 16, the handle portion 14 extends outwardly beyond the outside periphery of the toilet seat as can be best seen in FIG. 4.

In use, one merely grasps the handle portion 14 of the handle device 10 to raise or lower the toilet seat 16, thus not physically coming in contact with the seat.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A toilet seat handle device for attachment to a toilet seat as an aid to raising and lowering the toilet seat comprising:

a cylindrical base portion with upper and lower planar surfaces configured so as to fit with said upper planar surface against the bottom side of the toilet seat;

means for attaching the base portion to the bottom side of the toilet seat; and, a cylindrical handle portion unitarily constructed with said base portion so as to have a first end affixed to a circumferential surface of said base portion, and a second end extending radially outward from said base portion, such that when the base portion is attached to the toilet seat, the handle portion extends outwardly beyond the outside periphery of the toilet seat, said handle portion having a diameter at its first end substantially equal to a distance between the two planar surfaces of said base portion, said handle portion including a coating of material that glows so that the handle portion is visible in the dark.

2. The toilet seat handle device of claim 1 wherein the handle portion and the base portion are fabricated of a plastic material.

3. The toilet seat handle device of claim 1 wherein the attaching means comprises an adhesive material.

4. The toilet seat handle device of claim 1 wherein the attaching means comprises a fastener receiving hole formed through the base portion.

5. A toilet seat handle device for attachment to a toilet seat of the type having resilient support spacer bumpers attached to and projecting from the bottom side of the toilet seat in place of one of the resilient spacer bumpers as an aid to raising and lowering the toilet seat comprising:

a resilient cylindrical base portion configured to fit against the bottom side of the toilet seat in place of one of the spacer bumpers wherein the base portion has a thickness no greater than the thickness of the support spacer bumpers projecting from the bottom side of the toilet seat;

adhesive means for attaching the base portion to the bottom side of the toilet seat; and, a cylindrical handle portion unitarily constructed with said base portion and extending therefrom such that when the base portion is attached to the toilet seat, the handle portion extends outwardly beyond the outside periphery of the toilet seat.

6. The toilet seat handle device of claim 5 wherein at least the handle portion includes a coating of material that glows so that the handle portion is visible in the dark.

7. A toilet seat handle device for attachment to a toilet seat of the type having resilient support spacer bumpers attached to the bottom side of the toilet seat by screw fasteners as an aid to raise and lower the toilet seat comprising:

a resilient cylindrical base portion configured to fit against the bottom side of the toilet seat in the place of one of the spacer bumpers having a thickness substantially equal to the thickness of the spacer bumper;

a screw fastener receiving hole formed through the base portion to receive a screw fastener of a removed one of the resilient spacer bumpers to attach the base portion to the bottom side of the toilet seat in place of the removed one of the spacer bumpers; and, a cylindrical handle portion unitarily constructed with said base portion and extending therefrom such that when the base portion is attached to the toilet seat in place of one of the spacer bumpers the handle portion extends outwardly beyond the outside periphery of the toilet seat.

8. The toilet seat handle device of claim 7 wherein at least the handle portion includes a coating of material that glows so that the handle portion is visible in the dark.

* * * * *